US007762301B2

(12) United States Patent
Mathea

(10) Patent No.: US 7,762,301 B2
(45) Date of Patent: Jul. 27, 2010

(54) DEVICE FOR THE PRECISE POSITIONAL JOINING OF TWO MATERIAL WEBS

(75) Inventor: Hans Mathea, Eggenstei-Leopoldshafen (DE)

(73) Assignee: CSAT Gesellschaft für Computer-Systeme und Automalions-Technik mbH, Eggeustein-Leopoldshafen ( * ) Notice: Subject to any disclaimer, the term of this patent is extended or adjusted under 35 U.S.C. 154(b) by 1150 days.

(21) Appl. No.: 11/081,464

(22) Filed: Mar. 16, 2005

(65) Prior Publication Data

US 2005/0155713 A1 Jul. 21, 2005

Related U.S. Application Data

(63) Continuation-in-part of application No. PCT/DE03/02391, filed on Jul. 17, 2003.

(30) Foreign Application Priority Data

Sep. 16, 2002 (DE) ..... 102 43 084

(51) Int. Cl.

| | |
|---|---|
| ***B29C 65/78*** | (2006.01) |
| ***B32B 37/02*** | (2006.01) |
| ***B32B 37/14*** | (2006.01) |
| ***B32B 38/04*** | (2006.01) |
| ***B32B 38/18*** | (2006.01) |
| ***B65C 11/02*** | (2006.01) |
| ***B65B 57/02*** | (2006.01) |
| *B29C 65/02* | (2006.01) |
| *B32B 37/26* | (2006.01) |
| *B65B 1/24* | (2006.01) |

(52) U.S. Cl. ..... 156/378; 156/230; 156/240; 156/384; 156/387; 53/51; 53/64; 53/131.2; 53/131.3; 53/389.2; 53/438; 53/441; 53/505

(58) Field of Classification Search ..... 156/230, 156/240, 378, 384, 387
See application file for complete search history.

(56) References Cited

U.S. PATENT DOCUMENTS

| | | | | |
|---|---|---|---|---|
| 4,018,028 | A * | 4/1977 | Donnet | 53/51 |
| 4,349,997 | A * | 9/1982 | Hayasaka et al. | 53/51 |
| 5,964,151 | A * | 10/1999 | Mathea | 101/227 |
| 5,964,970 | A * | 10/1999 | Woolwine et al. | 156/64 |
| 6,164,200 | A * | 12/2000 | Mathea | 101/227 |

(Continued)

*Primary Examiner*—Philip C Tucker
*Assistant Examiner*—Sonya Mazumdar
(74) *Attorney, Agent, or Firm*—Klaus J. Bach

(57) ABSTRACT

In an arrangement for a position accurate joining of a first material web, which comprises elements in a section length separated by separating locations, with a second material web which is provided with marks arranged at a predetermined distance from each other corresponding to the section length—except for a possibly certain deviation, the arrangement includes a first device by which the two material webs are joined, a transport device by which the two material webs are moved stepwise by the predetermined distance, and a second device by which an element applied to the first material web when, after movement of the two material webs by a section length, the length of the material web between the first device and the second device corresponds to a predetermined multiple of the section length plus an offset, which is adjustable by an offset device, and a transport device by which the two material webs can be moved section-stepwise, wherein a sensor is provided by which the difference is determined and the offset is adjusted depending on the difference.

5 Claims, 2 Drawing Sheets

U.S. PATENT DOCUMENTS 6,286,428 B1 * 9/2001 Madsen ..... 101/485
2002/0020459 A1 * 2/2002 Baldwin et al. ..... 141/11
2006/0000540 A1 * 1/2006 Mathea ..... 156/64

* cited by examiner

DEVICE FOR THE PRECISE POSITIONAL JOINING OF TWO MATERIAL WEBS

This is a continuation-in-part application of international application PCT/DE03/02391 filed Jul. 17, 2003 and claiming the priority of German application 102 43 084.5 filed Sep. 16, 2002.

BACKGROUND OF THE INVENTION

The invention relates to an arrangement for the precise positional joining of a first material web which includes elements of sections having a section length divided by separation locations and a second material web which is provided with marks having a predetermined distance which corresponds to the section length, except possibly for a certain difference. The arrangement includes a first device by which the two material webs are joined, a transport device, by which the two material webs are advanced, stepwise, by the predetermined distance, and a second device by which an element is applied to the first material web when, after the advancing step of the two material webs by a section length, the length of the first material web between the first device and the second device corresponds to a predetermined multiple of the section length plus an offset length which is adjustable by an offset device, and a transport arrangement by which the two material webs can be advanced by the predetermined distance.

With such an arrangement for example so-called blister packages are produced by which for example tablets are distributed and sold. A blister package consists generally of a deep drawing film of plastic or paper including indentations in which the tablets are disposed and which are sealed by a cover foil. The cover foil is generally provided with imprints which generally include information concerning the tablets such as data when and which tablets should be taken. It is therefore very important that this information is applied to the cover foil accurately positioned according to the position of the tablets and consequently the indentations.

Although with modern printing techniques a high accuracy can be achieved, the position-accurate coordination of the imprint on the cover foil with respect to the deep drawing web is highly problematic since any deviations present may be added up. In time, the position of an imprint could deviate from the required position by an intolerable amount. Therefore, printing arrangements have been developed by which the position accuracy of the imprint on the cover foil has been substantially improved. U.S. Pat. No. 5,964,151 for example discloses an arrangement for a position-accurate imprinting of an endless foil without markings, by which imprints of a first predetermined length are applied to a metal foil and, after being imprinted, the foil is cut into sections of a certain predetermined length by a cutting device so that the imprints must be applied to the foil accurately between the cuts.

The known arrangement includes a printer which has an input for initiating a position-accurate printing procedure. Furthermore, there is a sensor which provides at its output a signal when the length of the foil between the cutting device and the location corresponding to the beginning of a section to be imprinted is a predetermined multiple of the second predetermined length.

Since the output of the sensor is connected to the output of the printer the beginning of a foil section to be imprinted is always newly determined. With the constant new determination of the beginning of the section to be imprinted errors possible present cannot be added up. Consequently, even relatively large deviations are generally harmless since errors present in one section do not influence the beginning of the next section to be imprinted.

Furthermore, U.S. Pat. No. 6,164,200 discloses another arrangement for the position-accurate imprinting of an unmarked endless foil, which operates according to the same principle as the printing arrangement described above. The main difference from the above printing arrangement resides in that the endless foil is transported in the earlier mentioned printing arrangement discontinuously whereas in the further printing arrangement the endless foil is continuously transported. However, the printer is also activated whenever the length of the endless foil between the section limit formed by the last cutting and the printing arrangement is a predetermined multiple of the second predetermined length.

Although these known arrangements provide for excellent results, it still has been found that, as a result of external influences, the imprint may be displaced with respect to the location of the indentations. Particularly after a stand-still of the arrangement, deviations sometimes occur, which are no longer tolerable.

U.S. Pat. No. 5,964,970 discloses an arrangement for the position-accurate joining of a first foil, on which elements of an absorbing material are disposed, with a second foil, to which imprint images are applied which include a reference mark. The imprints must correspond to the absorbing elements. The absorbing elements are applied to the first foil which advances at a constant speed, whereby the absorbing elements are disposed on the first foil at a distance from one another which can easily vary. The reference marks or, respectively, the associated imprints are disposed on the second foil at a constant distance from one another, which corresponds to the constant distance at which the absorbing elements of the first foil are arranged.

Before the two foils are joined the second foil is riffled in an apparatus whereby it is shortened. After the second foil has become shorter, it passes through a device in which it can again be stretched. The stretching depends on the position of the absorbing elements disposed on the first foil. With a reduced distance of the subsequent absorbing elements, less stretching takes place than when the elements are arranged at larger distances from one another. With the different stretching of the second foil consequently position displacements of the absorbing elements on the second foil can be corrected.

It is the object of the present invention to provide an arrangement of the type disclosed above in such a way that the position displacements of the elements disposed on the first material web with respect to the marks disposed on the second material web can be reduced.

SUMMARY OF THE INVENTION

In an arrangement for a position accurate joining of a first material web, which comprises elements in a section length separated by separating locations, with a second material web which is provided with marks arranged at a predetermined distance from each other corresponding to the section length—except for a possibly certain deviation, the arrangement includes a first device by which the two material webs are joined, a transport device by which the two material webs are moved stepwise by the predetermined distance, and a second device by which an element applied to the first material web when, after movement of the two material webs by a section length, the length of the material web between the first device and the second device corresponds to a predetermined multiple of the section length plus an offset, which is adjustable by an offset device, and a transport device by which the two material webs can be moved section-stepwise, wherein a sensor is provided by which the difference is determined and the offset is adjusted depending on the difference.

Since a sensor is provided by which the differences are determined, any position displacements of the elements applied to the first material web relative to the marks on the second material web are recognized. By the adjustment of the offset depending on the difference the position displacements can be corrected.

That means that, with any change in the predetermined distance between the marks of the second material web, also the transport length changes by which the second material web is advanced by a section and, since the first material web is joined to the second material web, also the respective transport length of the first material web. Since the elements, after the advance of the two material webs by a section length, are applied to the material web always when the length of the first material web between the first device and the second device is a multiple of the section length, the elements are displaced relative to the separation locations which are newly defined on the basis of the changed transport length. By the adjustment of the offset depending on the difference the displacement can be compensated for. Consequently, the position of the elements on the first material web are corrected even if the transport length of the first material web changes, for example, by a change of the distance of the marks present on the second material web.

The arrangement according to the invention is particularly advantageous for the position-accurate joining of an aluminum foil provided with an imprint and a plastic foil which includes indentations.

A particular embodiment of the invention has been found to especially advantageous wherein the sensor is so arranged that the length of the second material web between the sensor and the first device corresponds to the length of the second material web between the first device and the second device when the application of the element is initiated. In this way, the sensor detects the sum of the differences up to the sensor position. Furthermore, the correction of the position of the element on the first material web with respect to the first device occurs at the same place where the difference of the section length is determined. This has the advantageous result that the position of the element on the first material web can be corrected in a simple manner. For the correction of the position of the element on the first material web essentially no special measures are required.

If the offset corresponds to the difference as it is provided for in another particular embodiment of the invention, an almost 100% correction is achieved so that an error is not even noticeable.

In another embodiment of the invention, the difference detected by the sensor is divided by the number of marks of the second material web which are disposed between the sensor and the first device when the application of the elements is initiated and the offset corresponds to the product of the result of the division and the predetermined multiple of the section length. Such an embodiment of the invention is particularly advantageous if the sensor cannot be arranged at the location where the length of the second material web between the sensor and the first device corresponds to the length of the first material web between the first device and the second device when the application of the element is initiated. If the sensor cannot be arranged in such a way that the length of the second material web between the sensor and first device corresponds to the length of the first material web between the first device and the second device when the application of the element is initiated, it is necessary to calculate the offset.

By dividing the sum of the differences by the number of markings of the part of the second material web present between the sensor and the first device when the application of the element is initiated, the difference per marking is determined. If this difference is multiplied by the predetermined multiple of a section length which corresponds to the length of the first material web between the first device and the second device at the time of initiation of the application of the element, a difference is obtained which would be present at the location if the length of the second material web between the sensor and the first device would correspond to the length of the first material web between the first device and the second device at the time of initiation of the application of the element. If the offset is adjusted in accordance with the difference calculated in this way, the error is very well corrected.

With the arrangement, according to the invention it is possible, particularly after a shut-down of a blister packaging machine because of a uniform deviation of the position of the print image B with respect to the recesses, to re-establish the position accuracy of the print B in a very short time.

Further details, features and advantages of the invention will become apparent from the following description of a particular embodiment with reference to the accompanying drawings:

DESCRIPTION OF A PARTICULAR EMBODIMENT

Figure 1:
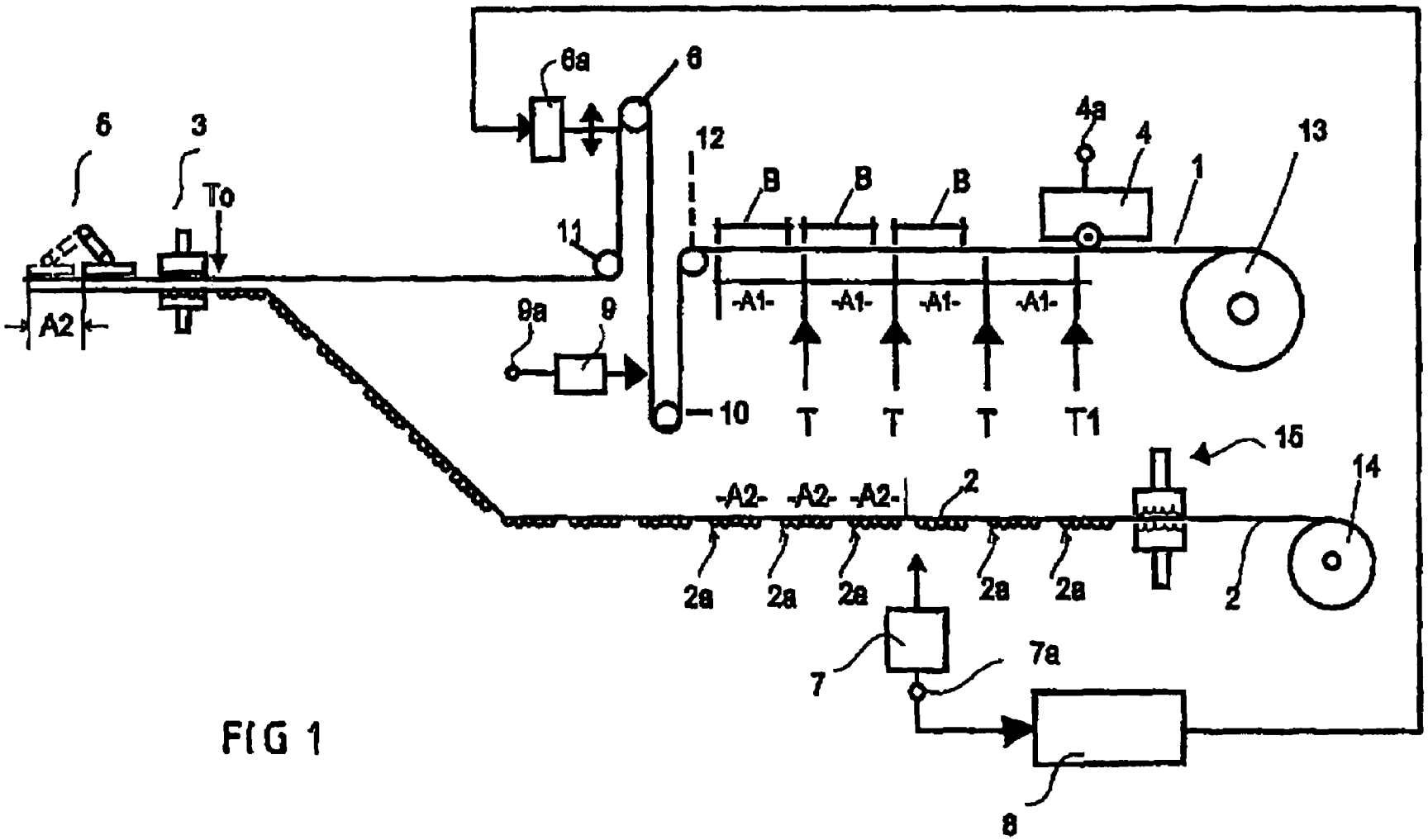
FIG. 1 is a schematic representation of the arrangement according to the invention.

As apparent from FIG. 1, a first material web 1 in the form of an aluminum foil is joined in accordance with the invention in a first device 3, which is a sealing station, with a second material web 2, which is a plastic foil. The plastic foil 2 includes indentations (so-called yards). Several indentations are combined in groups of which—in travel direction—the front edge of the first indentation represents a mark 2*a*. The marks 2*a* are disposed at a predetermined distance A2 from one another.

The indentations are stamped, by a stamping tool 15, into the plastic foil 2 which is unwound from a roll 14.

In a filling station which is not shown in FIG. 1, tablets are placed into the indentations. After the tablets are deposited in the indentations, the indentations are covered and sealed by the aluminum foil 1 in the sealing station 3. In this way, a so-called blister package is formed. Since such blister packages must generally include information, an image B is imprinted onto the aluminum foil 1 which has to be accurately positioned over the respective indentations after completion of the package.

For imprinting the aluminum foil 1 which is unwound from a roll 13, the aluminum foil is moved continuously through a printer 4 in which the aluminum foil is imprinted. For initiating a printing procedure the printer has an input 4*a*. In the transport direction after, the printer 4, the aluminum foil passes over a reversing roller 12 and then extends in an S-shaped pattern over a compensating roller 10 and an offset roller 6. The compensating roller 10 and the offset roller 6 are arranged each at the bottom of opposite loops which are formed by the course of the aluminum foil 1. After the offset roller 6, the aluminum foil 1 passes over another reversing roller 11. After the second reversing roller 11, there is a transport device 5 by which the aluminum foil 1 is advanced stepwise by the length A1 of a section in which the imprinted image B must be accurately positioned. Between the sections, there is a theoretical separation location T.

Ahead of the transport device 5, the sealing device 3 is arranged wherein the aluminum foil 1 is joined with the plastic foil 2. Consequently, by means of the transport device 5, also the plastic foil 2 is advanced.

The two foils 1, 2 are advanced by the transport device 5 until the mark 2*a* formed by the front edge of a first indentation has arrived at a fixed point T0 of the sealing station 3. That is, the two foils 1, 2 are advanced until the front edge 2*a* of the first indentation of the next group of indentation of indentations has arrived at the fixed point T0. Since the front edges 2*a* are disposed at a predetermined distance A2 from one another both foils 1, 2 are advanced by the predetermined distance A2.

The compensating roller 10 and the offset roller 6 are so arranged that they can be moved toward, and away from, one another. While the offset roller 8 can be fixed in position and is movable only by an adjustment unit 6*a* the compensating roller 10 is freely movable.

In the lower area of the loop of the aluminum foil 1 extending around the compensating roller 10, a compensating roller sensor 9 is arranged. The compensating roller sensor 9 is designed as a photoelectric barrier and includes an output 9*a*. At the output 9*a* of the compensating roller sensor 9, a signal is provided when the compensating roller 9 is in a particular position in front of the compensating roller sensor 9. The output 9*a* of the compensating roller sensor 9 is connected to the input 4*a* of the printer 4.

During the period in which the foils 1, 2 are at a stand-still, the part of the aluminum foil 4 which is disposed between fixed point T0 and the printer 4 becomes longer as the aluminum foil 1 is moved continuously through the printer 4. As a result, the compensating roller 10 moves downwardly. The compensating roller 10 moves downwardly until the two foils 1, 2 are advanced by the transport device 5. The representation in FIG. 1 corresponds about to the point in time when the transport device 5 begins to again advance the two foils 1, 2.

During the advance of the two foils 1, 2 which occurs at a speed which is a multiple of the speed at which the aluminum foil 1 is moved through the printer 4, the length of the aluminum foil 1 between the fixed point T0 and the printer 4 is shortened. By the shortening of the length, the compensation roller 10 is moved upwardly so that it is disposed above the compensation roller sensor 9.

When the advancement of the two foils 1, 2 by the transport device 5 has ended and the two foils 1, 2 are again at rest, the compensation roller 10 moves again downwardly by the continuous movement of the aluminum foil 1 through the printer 4. At the instance when the compensation roller 10 reaches the position in which the compensation roller sensor 9 supplies, via its output 9A, a signal to the input 4A of the printer, the length of the aluminum foil 1 between the fixed point T0 and the location T corresponding to beginning of a section to be imprinted is for example twelve times the length A1 of a section. Since the printer receives a printing signal exactly at that moment, an imprint is applied exactly at the beginning T of a section to be imprinted.

As long as the length A1 of a section to be imprinted corresponds to the predetermined distance A2 at which the marks 2*a* are arranged relative to one another, an imprint 13 is accurately positioned within the section to be imprinted. However, since the predetermined distance A2 can change for example as a result of outside influences so that it no longer corresponds to the section length A1 but the section length differs by a difference D which is added or subtracted, the two foils 1, 2 and, consequently, the aluminum foil 1 are advanced by a section length A1 plus, or respectively, minus the difference D. But since the image is imprinted onto the aluminum foil independently of the advance amount of the aluminum foil 1, the imprint B is displaced with respect to the indentations of the aluminum foil.

The arrangement therefore includes an edge sensor 7 by means of which it can be determined by which distance the position of a front edge 2*a* of the first indentation of a group has been displaced. If in the groups of indentations which are disposed between the edge sensor 7 and the fixed point T0 the predetermined distance A2 of the front edge of the first indentation of a group indentation from the front edge 2*a* of the first indentation of the next group of indentations has not changed, the edge sensor 7 provides a signal corresponding to a correct distance.

If in the groups of indentations which are disposed between the edge sensor 7 and the fixed point T0, the predetermined distance A2 between the front edge 2*a* of the first indentation of a group of indentations and the front edge 2*a* of the first indentation of the next group of indentations is shortened, the edge sensor 7 provides a signal which corresponds to the sum of the individual reductions of the distances A2 between front edges 2*a* of the indentation groups.

If, in the groups of indentations, which are disposed between the edge sensor 7 and the fixed point T0, the predetermined distance A2 between the front edge 2*a* of the first indentation of a group of indentation and the first indentation of the next group of identities has become larger, the edge sensor 7 provides a signal which corresponds to the sum of the individual increases of the distance A2 between the front edges 2*a* of the first indentations.

In a control device 8, which is connected to the edge sensor 7, from the signal of the edge sensor 7 the decrease or, respectively, increase of the distance A2 between the front edge 2*a* of the first indentation of two adjacent groups of indentations is determined. This occurs in that the sum of all the displacements is divided by the number of groups of indentations which are disposed between the edge sensor 7 and the fixed point T0. This value is then multiplied in the control unit 8 by the multiple of the section length A1 which is based on the length of the part of the aluminum foil (1) between the fixed point T0 and the printer 4. By this value then the offset roller 6 is displaced by the adjustment device 6*a*. In this way, a correction of the position of the imprint 13 on the aluminum foil is achieved.

The correction procedure described above will be described below on the basis of FIGS. 2 to 4.

Figure 2:
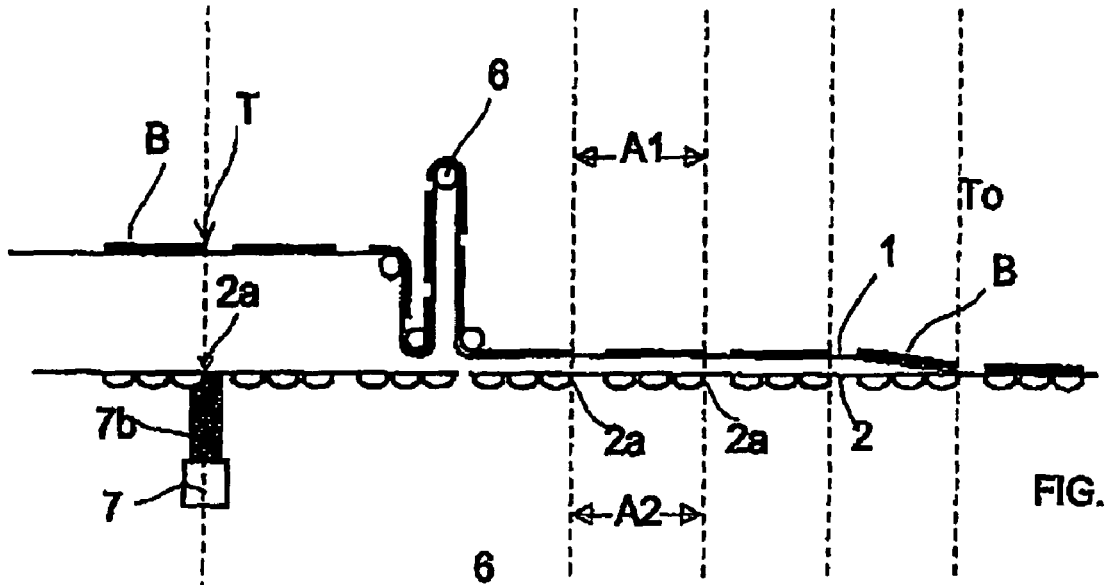
FIG. 2 is a schematic representation of two joined webs wherein the predetermined distance corresponds to the section length.

In the state as shown in FIG. 2, the section length A1 of the aluminum foil 1 in which an imprint B is arranged corresponds to the predetermined distance A2 of the plastic foil 2, at which the front edges 2*a* of the first indentations of two adjacent groups of indentations are disposed. The front edge 2*a* of the first indentation in front of the edge sensor 1 is disposed in the center of an area 7*b* which can be surveyed by the edge sensor 7. The offset roller 6 is in its basic position.

That means it is so adjusted that the printer 4 applies the image B to the aluminum foil 1 in such a way that it begins at the separation location T between two adjacent sections.

Figure 3:
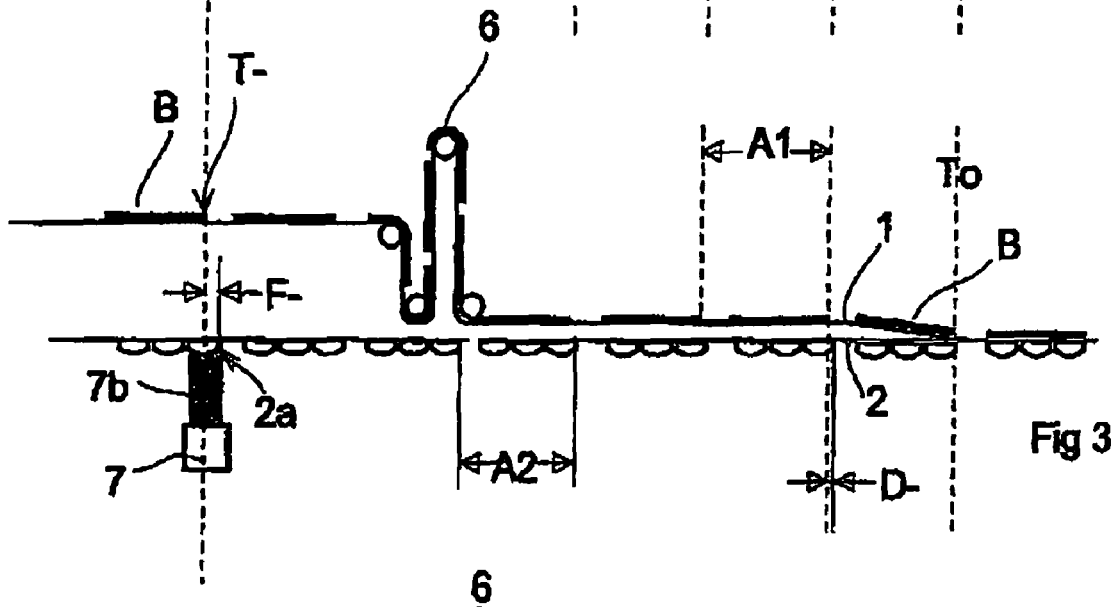
FIG. 3 is a schematic representation of two joined webs, wherein the predetermined distance of the markings is smaller than the section length.

In the state as shown in FIG. 3, the predetermined distance A2 at which the front edges 2*a* of the front indentations of two subsequent groups of indentations are arranged, has decreased as it may happen for example by shrinking of the plastic foil 2. The predetermined distance A2 consequently does not equal any more the section length A1 of the aluminum foil 1. It has become smaller by a difference D−. Therefore, the aluminum foil 1 is no longer advanced by the section length A1 but by a predetermined length A2 which is smaller by the difference D− so that the imprinted image B would start with respect to the preceding separation location T already in the preceding section. With a correction of the position of the offset roller 6, the position of the printing image B is moved back until it is disposed at the corresponding, new separation line T− corresponding to the advance of the aluminum foil by the section length A1 minus the difference D−.

With this reduction of the predetermined distance A2, the front edge 2*a* of the first indentation ahead of the edge sensor 7 is no longer in the center of the area 7*b* covered by the edge sensor 7 but at the right edge thereof. The front edge 2*a* of the first indentation has moved to the right by the amount F−, which corresponds to the sum of the differences D− of the groups of indentations disposed between the fixed point T0 and the edge sensor 7. The output signal of the edge sensor 7, which has changed therefore, is used for the correction of the offsets by the offset roller 6. This means that the position of the offset roller b is changed such that the imprint image B is disposed at the new separation line T−.

Figure 4:
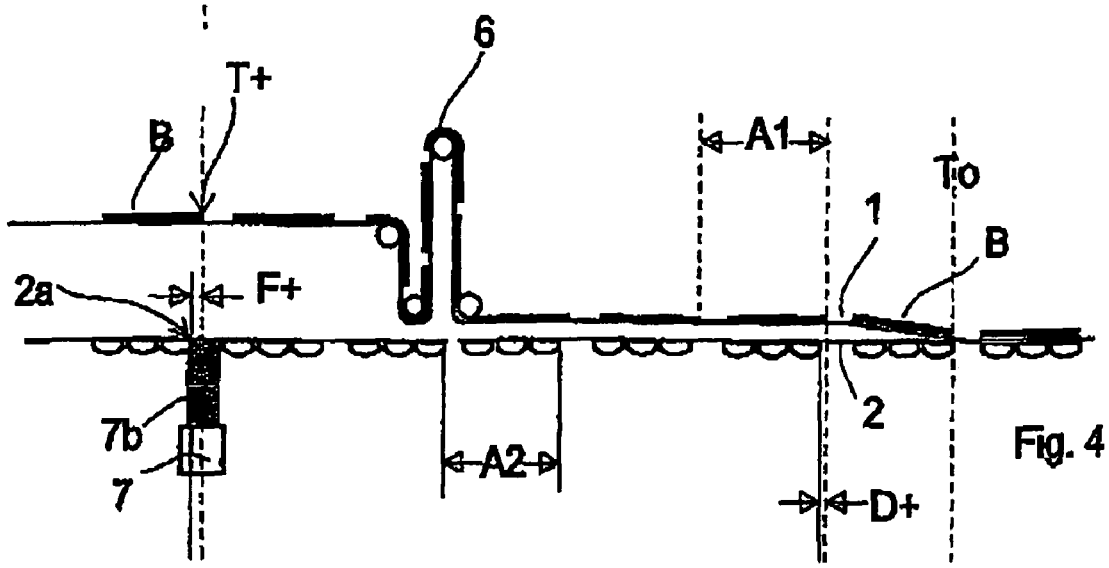
FIG. 4 is a schematic representation of two joined webs, wherein the predetermined distance of the markings is larger than the section length.

In the state as shown in FIG. 4, the predetermined distance A2 has become larger. The predetermined distance A2 therefore no longer corresponds to the section length A1 of the aluminum foil 1. It has become larger by a distance D+. Consequently, the aluminum foil is no longer advanced by the section length A1 but by the predetermined distance A2 which is greater by the difference D+. As a result, the imprinted image B would start at a distance from the separation location T with regard to the earlier separation location 7. By a correction of the position of the offset roller 6 the position of the imprinted image B is moved until it is disposed at the new separation location T+ corresponding to the advancement of the aluminum foil 1 by the section length A plus the difference D+.

By the reduction of the decrease of predetermined distance A2, the front edge 2*a* of the first indentations which is in front of the edge sensor 7 is no longer in the center of the area 7*b* covered by the edge sensor 7, but at the left edge thereof. The front edge 2*a* of the first indentation has moved to the left by the amount F+ which corresponds to the sum of the differences D+ of the groups of indentations disposed between the fixed point T0 and the edge sensor 7. The output signal of the edge sensor 7 which is changed as a result thereof is used for the correction of the offset adjusted by the offset roller 6. That is, the position of the offset roller 6 is changed such that the imprinted image B is at the new separation location T+.

Although for the description of the present invention a printing apparatus as known from DE 195 25 713 C1 has been used the application of the invention is not limited to this particular printing apparatus. Although the two material webs are described as being two foils to be joined, wherein the imprinted image is applied to one foil, the image may be applied with any type of printer particularly with a so-called plate printer, flexo-printer or screen printer.

Furthermore, it is not necessary that the sections of the two material webs are advanced discontinuously. The invention may as well be used in an arrangement wherein the material webs are continuously advanced as for example in accordance with U.S. Pat. No. 6,164,200.

What is claimed is:

1. Arrangement for the precise positional joining of a first material web (1), comprising sections of a section length (A1), each including an element (B), and a second material web (2), having marks (2*a*) disposed at a predetermined distance (A2) from one another, which, except for a possible difference (D), corresponds to the section length (A1), said arrangement comprising a first device (3), by which the two material webs (1, 2) are joined, a transport device (5), by which the two material webs (1, 2) are advanced section-wise by the predetermined distance (A2) and a second device (4), by which an element (B) is applied to the first material web (1) whenever, after the advancement of the two material webs (1, 2) by a section, the length of the first material web (1) between the first device (3) and the second device (4) corresponds to a multiple of the section length (A1) plus possibly an offset which is adjustable by an offset arrangement (6, 6*a*), and a sensor (7) by which the difference (D) can be determined and the offset is adjusted by the offset arrangement (6, 6*a*) dependent on the difference (D).

2. Arrangement according to claim 1, wherein the arrangement is used for the precise positional joining of an aluminum foil (1) provided with an imprinted image (B) and a plastic foil (2) provided with indentations (2*a*).

3. Arrangement according to claim 1, wherein the sensor (7) is so arranged that the length of the second material web (2) between the sensor (7) and the first device (3) corresponds to the length of the first material web (1) between the first device (3) and the second device (4) when the application of the element (B) is initiated, and the sensor (7) detects the sum (F) of the differences (D) up to the sensor position.

4. Arrangement according to claim 3, wherein the offset corresponds to the sum (F) of the differences (D).

5. Arrangement according to claim 3, wherein the sum (F) of the differences is divided by the number of the marks (2*a*) of the part of the second material web (2) which is disposed between the sensor (7) and the first device (3) when the application of the element (B) is initiated, and the offset corresponds to the product of the result of the division and the predetermined multiple of the section length (A1).

* * * * *